US006681405B2

(12) United States Patent
Yachimec et al.

(10) Patent No.: US 6,681,405 B2
(45) Date of Patent: Jan. 27, 2004

(54) METHOD AND APPARATUS FOR POSITIONING A GARMENT WHILE BREASTFEEDING

(76) Inventors: Loretta Linda Yachimec, 12629-70 Street, Edmonton, Alberta (CA), T5C 0J6; Joanne Lee Marie Howe, 17072-114 Street, Edmonton, Alberta (CA), T5X 5X7

( * ) Notice: Subject to any disclaimer, the term of this patent is extended or adjusted under 35 U.S.C. 154(b) by 0 days.

(21) Appl. No.: 10/372,460

(22) Filed: Feb. 21, 2003

(65) Prior Publication Data

US 2003/0159195 A1 Aug. 28, 2003

(30) Foreign Application Priority Data

Feb. 25, 2002 (CA) ..... 2372957

(51) Int. Cl.[7] ..... A41D 1/20
(52) U.S. Cl. ..... 2/104
(58) Field of Search ..... 2/104, 125, 126, 2/105–107, 49.1, 48, 74, 50–52, 920, 115, 270, 69

(56) References Cited

U.S. PATENT DOCUMENTS

| | | | | |
|---|---|---|---|---|
| 4,446,572 | A | 5/1984 | Lindquist | 2/104 |
| 4,712,251 | A | 12/1987 | Cobble | 2/104 |
| 4,875,492 | A | 10/1989 | Mitchell et al. | 128/890 |
| 4,878,879 | A | 11/1989 | Kunstadter | 450/36 |
| 5,893,171 | A | 4/1999 | Ries | 2/48 |
| 6,074,273 | A | 6/2000 | Turner et al. | 450/37 |
| 6,081,925 | A | 7/2000 | Reiber | 2/125 |
| 6,175,961 | B1 | 1/2001 | Linden et al. | 2/125 |
| 6,427,244 | B1 | 8/2002 | Speier et al. | 2/104 |

*Primary Examiner*—Tejash Patel
(74) *Attorney, Agent, or Firm*—Davis & Bujold, PLLC

(57) ABSTRACT

A method and apparatus for positioning a garment while breastfeeding. A first step involves providing a strap with means for securing the strap to itself. A second step involves raising a garment of a mother to a raised position with a breast of the mother exposed. A third step involves maintaining the garment in the raised position by extending the strap through a neck of the garment and around the lower hem of the garment to form a loop and securing the strap to itself. It is preferred that the strap have an indicator which identifies whether the mother should be breastfeeding from her left breast or her right breast.

11 Claims, 6 Drawing Sheets

METHOD AND APPARATUS FOR POSITIONING A GARMENT WHILE BREASTFEEDING

FIELD OF THE INVENTION

The present invention relates to a method and an apparatus for positioning a garment while breastfeeding.

BACKGROUND OF THE INVENTION

The use of both hands is recommended when a mother is breastfeeding. It is also important that the mother have clear observation of her breast and the infant. This allows the mother to ensure that her infant has a proper latch onto the breast. This is important as a proper latch prevents sore breasts and allows for adequate milk intake by the infant.

It is difficult for a mother, especially a new mother, to nurse properly if one hand must be occupied with holding up her garment. Sometimes a mother will try to free her hands by using her chin to hold up the garment. This posture can lead to serious neck strain, as a new infant may take up to an hour to feed. Sometimes a mother will try to tuck the garment in an out of the way position. This usually is ineffective, as the garment tends to slowly fall back down and the nursing mother must repeatedly tuck the garment back into position.

SUMMARY OF THE INVENTION

What is required is a method and an apparatus for positioning a garment while breastfeeding.

According to one aspect of the present invention there is provided a method for positioning a garment while breastfeeding. A first step involves providing a strap with means for securing the strap to itself. A second step involves raising a garment of a mother to a raised position with a breast of the mother exposed. A third step involves maintaining the garment in the raised position by extending the strap through a neck of the garment and around the lower hem of the garment to form a loop and securing the strap to itself.

By following the teachings of the method, as described above, a mother is able to maintain the positioning of her garment while breastfeeding her baby. This enables the mother to use both hands. It also enables the mother to have clear observation of both her breast and the infant.

Although beneficial results may be obtained through the use of the method, as described above, problems may arise if the mother does not nurse equally from both her left breast and her right breast. It is essential to feed from both breasts in order to increase breast stimulation, hormone levels, milk supply and milk volume. During breastfeeding the composition of the breast milk changes. Initially the infant receives "foremilk". After approximately ten minutes at the breast, the infant begins to receive "hindmilk". Hindmilk is rich in fat and contains antibodies. An adequate amount of hindmilk is essential to ensure that the infant gains weight. When a mother who has lots of milk changes breasts often during a single feeding, the infant may receive too much "foremilk". Foremilk contains higher levels of lactose. In some infants too much foremilk can cause gastrointestinal upset or colic. Insofar as the health of the mother is concerned, engorgement may occur when the breasts are not sufficiently drained. Ensuring that the breasts are drained evenly and as completely as possible can help prevent engorgement.

In view of the above concerns that can adversely affect the health of both the infant and the mother, even more beneficial results may be obtained when the strap has an indicator which identifies whether the mother should be breastfeeding from her left breast or her right breast.

According to another aspect of the present invention there is provided an apparatus for positioning a garment while breastfeeding which includes a strap and means for securing the strap to itself. An indicator is attached to the strap. The indicator identifies whether a mother should be breastfeeding from her left breast or her right breast.

BRIEF DESCRIPTION OF THE DRAWINGS

These and other features of the invention will become more apparent from the following description in which reference is made to the appended drawings. The drawings are for the purpose of illustration only and are not intended to, in any way, limit the scope of the invention to the particular embodiment or embodiments shown, wherein.

DETAILED DESCRIPTION OF THE PREFERRED EMBODIMENT

Figure 1:
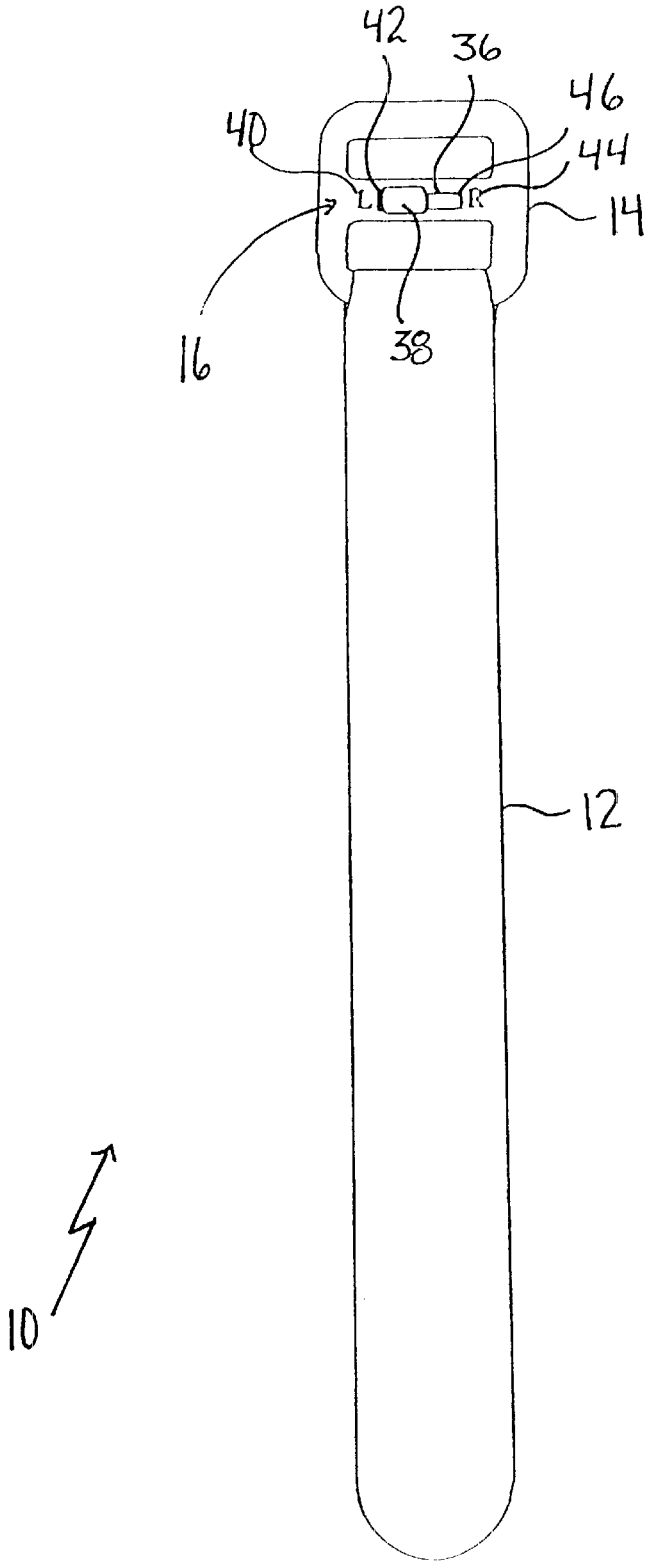
FIG. 1 is a top plan view of an apparatus for positioning a garment while breastfeeding constructed in accordance with the teachings of the present invention.

The preferred embodiment, an apparatus for positioning a garment while breastfeeding generally identified by reference numeral 10, will now be described with reference to FIGS. 1 through 4.

Figure 2:
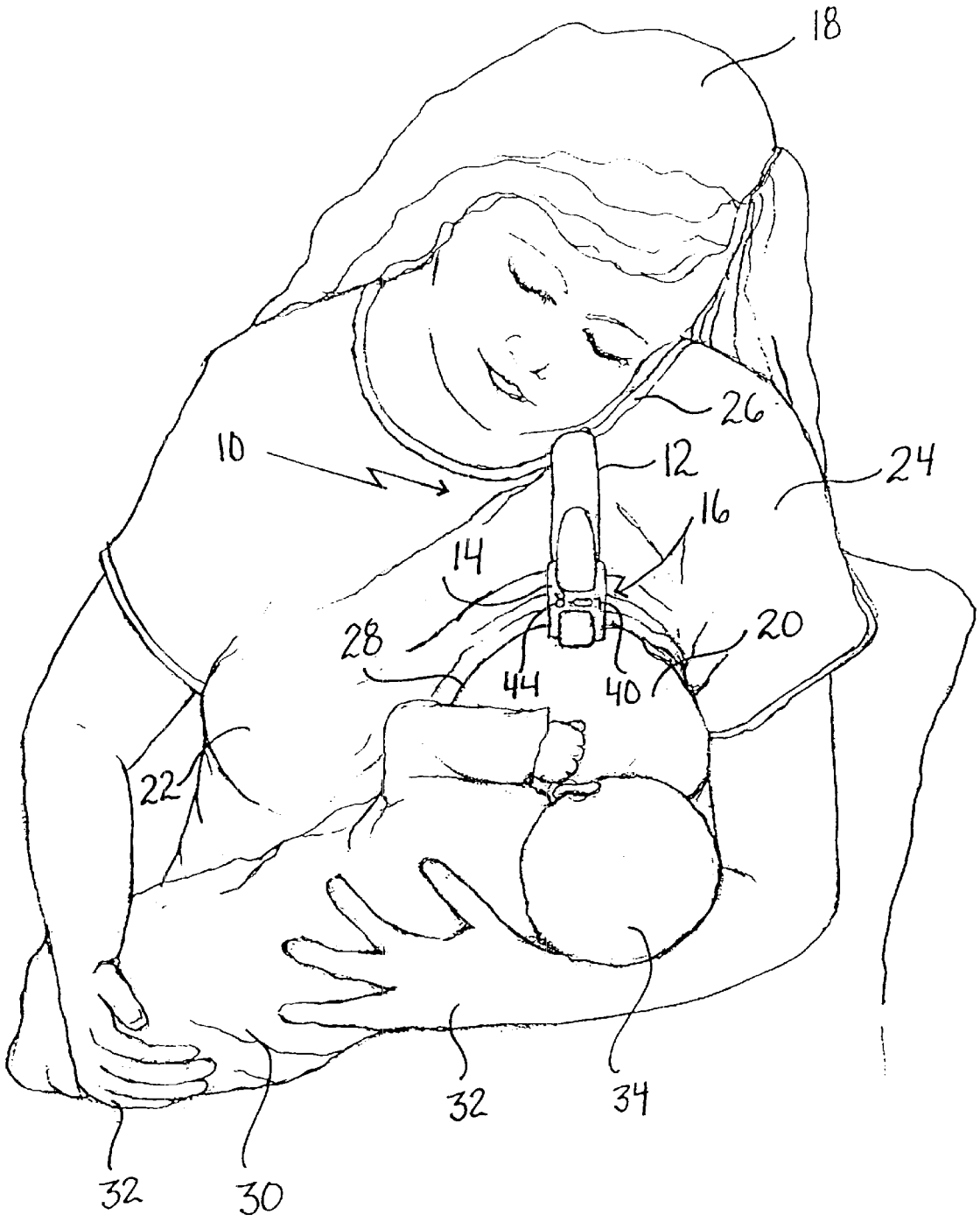
FIG. 2 is a perspective view of a mother using the apparatus illustrated in FIG. 1 during breastfeeding.

Structure and Relationship of Parts:

Referring to FIG. 1, apparatus 10 includes a strap 12 and buckle 14 for securing strap 12 to itself. An indicator, generally referenced by numeral 16, is attached to strap 12. In the illustrated embodiment, indicator 16 is formed as part of buckle 14, however it will be appreciated that indicator 16 could be separate from buckle 14 as will hereinafter be described. Referring to FIG. 2, indicator 16 identifies whether a mother 18 should be breastfeeding from her left breast 20 or her right breast 22. It is preferred that indicator 16 glow in the dark, as the mother will frequently be breastfeeding at night or in darkened rooms.

Operation:

Referring to FIGS. 1 through 4, the use of apparatus 10 will now be described in accordance with the teachings of the preferred method.

Referring to FIG. 2, when it becomes time to nurse, mother 18 raises her garment 24 to a raised position with left breast 20 of mother 18 exposed. In order to maintain garment 24 in the raised position, strap 12 is extended through a neck 26 of garment 24 and around lower hem 28 of garment 24 to form a loop by securing strap 12 to itself through buckle 14. This prevents garment 24 from interfering with a baby 30 that is nursing. It also allows the hands 32 of mother 18 to be free to hold baby 30 and support baby's head 34 during breastfeeding. Indicator 16 identifies whether mother 18 should be breastfeeding from her left breast 20 or her right breast 22.

Referring to FIG. 1, in the illustrated embodiment, indicator 16 has a horizontal slotted opening 36 in which a movable marker 38 is positioned. An "L" character 40 representing left is marked on indicator 16 adjacent to a first end 42 of slotted opening 36, and an "R" character 44 representing right is marked on indicator 16 adjacent to a second end 46 of slotted opening 36. Referring to FIG. 2, indicator 16 is positioned on strap 12 so that mother 18 can view "L" character 40 and "R" character 44 on indicator 16. Referring to FIG. 1, marker 38 can be moved in slotted opening 36 from first end 42 to second end 46 to indicate to mother 18 whether she should be breastfeeding from her left breast 20 or her right breast 22. If marker 38 is at first end 42 of slotted opening 36 adjacent to "L" character 40, then mother 18 knows she should be breastfeeding from her left breast 20. Alternatively, if marker 38 is at second end 46 of slotted opening 36 adjacent to "R" character 44, then mother 18 knows that she should be breastfeeding from her right breast 22. The "L" character 40, the "R" character 44, and marker 38 glow in the dark, so as to be clearly visible at night.

Figure 4:
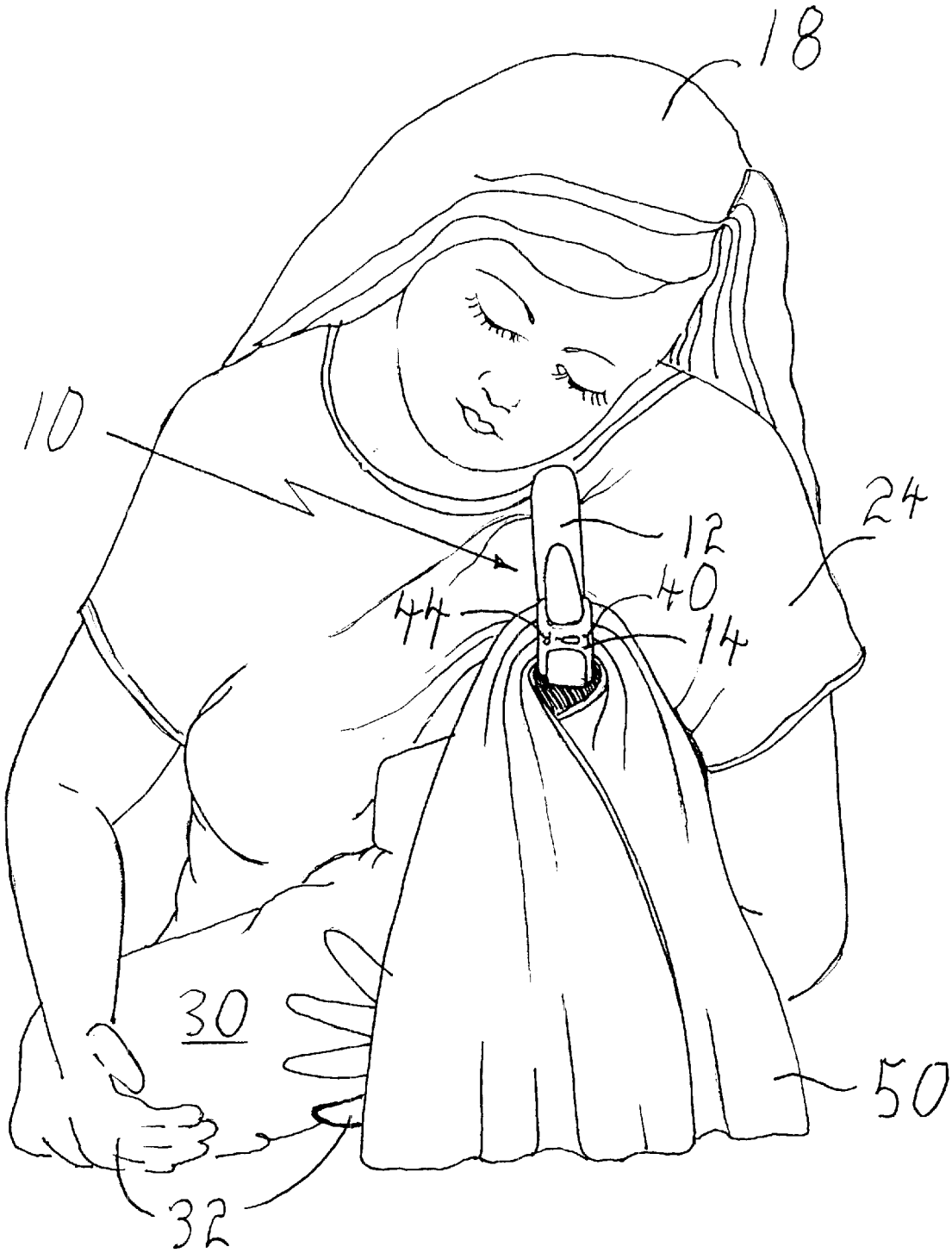
FIG. 4 is a perspective view of a mother using the apparatus illustrated in FIG. 1 during breastfeeding with a baby blanket according to the teachings of the present invention.

Referring to FIG. 4, there is illustrated a preferred method of using apparatus 10 to support a baby blanket 50. In accordance with this aspect of the invention, strap 12 is wrapped around garment 24, as described above. Baby blanket 50 is then pulled through the loop of strap 12 and positioned. There are a number of reasons why it may be desirable to use baby blanket 50 when nursing. When nursing in public, baby blanket 50 may be used for privacy, so that the mother may nurse discretely. When nursing outdoors, baby blanket 50 may be used to shield the baby from the elements, such as sunlight, wind, rain, and the like. Although it is envisaged that a baby blanket or towel will be used in most cases, it will be understood that any form of draping material may be used.

Figure 3:
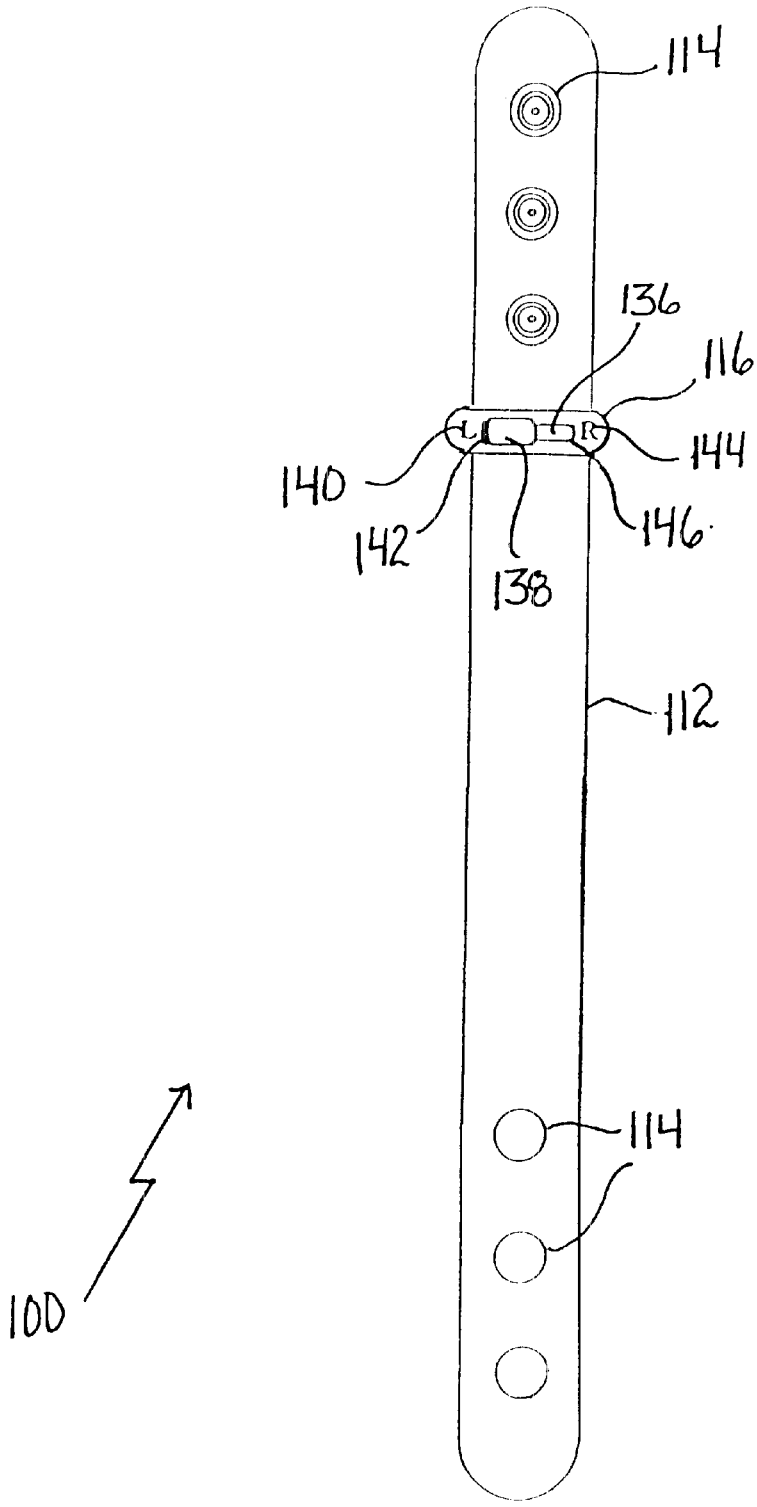
FIG. 3 is a top plan view of a first alternative embodiment of apparatus for positioning a garment while breastfeeding.

Variations:

With apparatus 10, which is the preferred embodiment, indicator 16 forms a part of buckle 14. Referring to FIG. 3, a first alternative embodiment is illustrated which is generally identified by reference numeral 100. This alternative embodiment does not have a buckle 14, and is intended to demonstrate that indicator does not have to be part of the buckle. Apparatus 100 includes a strap 112 and snaps 114 for securing strap 112 to itself. An indicator 116 is attached to strap 112. As with first embodiment, indicator 116 has a horizontal slotted opening 136 in which a movable marker 138 is positioned. Movable marker 138 can be moved between a first end 142 of slotted opening 136 with an adjacent "L" character 140 and a second end 146 of slotted opening 136 with an "R" character 144. The manner in which indicator 116 of alternative embodiment 100 is used is identical to that of first embodiment 10.

Figure 5:
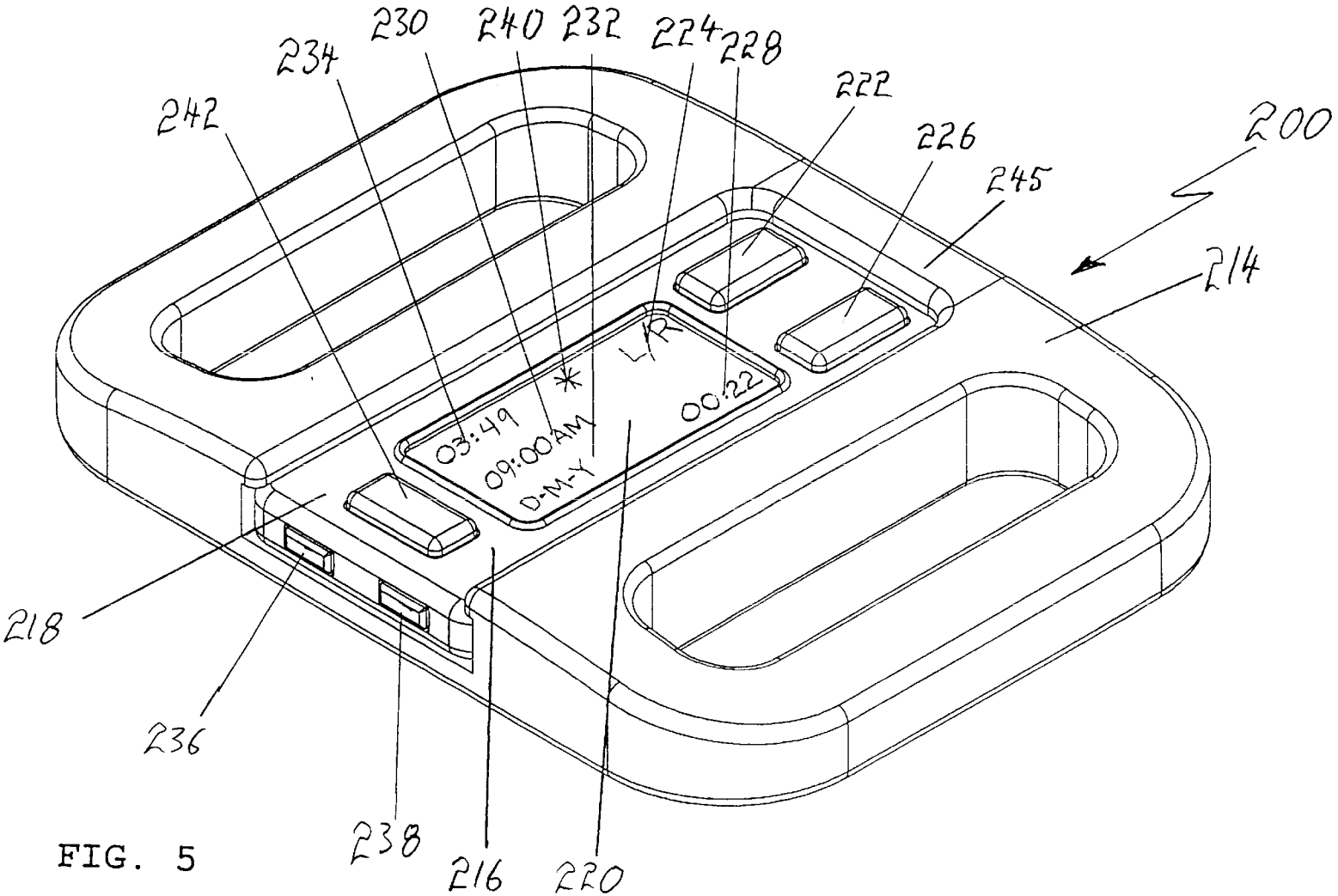
FIG. 5 is a top perspective view of a second alternative embodiment of apparatus for positioning a garment while breastfeeding utilizing digital technology with a digital readout module.

Referring to FIG. 5, a discussion of variations would not be complete without including the use of modern digital technology. A second alternative embodiment is identified by reference numeral 200. Alternative embodiment 200 has a buckle 214 which is used with a strap (not shown). Buckle 214 includes an indicator 216 which is in the form of a digital readout module 218. Digital readout module 218 has an liquid crystal display (LCD) 220. A left/right toggle button 222 is provided that causes either an "L" or an "R" to appear on an left/right display portion 224 of LCD 220. A button 226 is provided which controls a stop watch which is used to time the length of nursing. A display of running time appears as stop watch display 228 on LCD 220. A clock function is also provided with time being displayed as clock display 230 on LCD 220. A date function is provided to indicate the date, with the date appearing as date display 232 on LCD 220. A timer function is provided in order to indicate when it is again time to nurse the baby. A timer display 234 is provided on LCD 220 which counts down the time to the next feeding. The timer function is set using a mode button 236 in combination with a set button 238. Depending upon the mode selected with mode button 236, set button 238 can also be used to set the time and date. When the timer runs down an auditory alarm sounds and an alarm mode is displayed as alarm indicator 240 on LCD 220. The auditory alarm can be armed or disarmed using alarm button 242.

Figure 6:
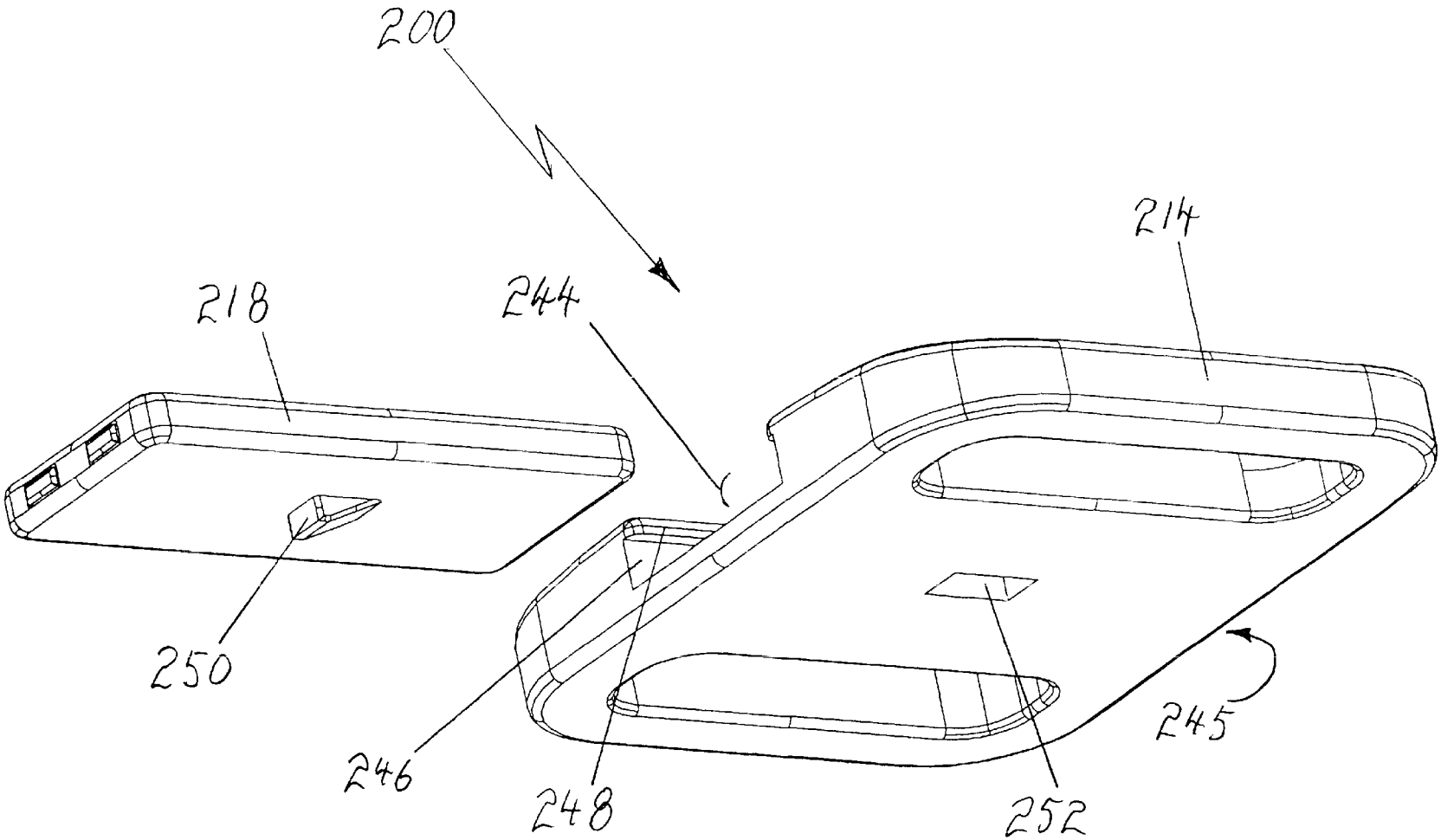
FIG. 6 is a bottom perspective view of the second alternative embodiment illustrated in FIG. 1, with digital readout module removed.

Referring to FIG. 6, digital readout module 218 is detachably secured to buckle 214. This may be done in a variety of ways. In the illustrated second embodiment 200, digital readout module 218 slides into a receiving channel 244 in buckle 214 which has a closed end 245 and a single access opening 246 opposite closed end 245. Receiving channel 244 has an inwardly extending peripheral flange 248, which prevents removal of digital readout module 218 from the top of receiving channel 244. Closed end 245 of receiving channel 244 serves as a stop to limit entry of digital readout module 218. Digital readout module 218 has a depending locking member 250 which engages a member receiving opening 252 in buckle 214. Locking member 250 prevents inadvertent removal of digital readout module 218 from receiving channel 244. Digital readout module 218 may be removed from receiving channel 244 of buckle 214 by exerting a force from below upon locking member 250 to dislodge locking member 250 from member receiving opening 252. Upon locking member 250 being released, digital readout module 218 slides freely from receiving channel 244. Removal of digital readout module 218 is desirable in order to permit cleaning of buckle 214 and associated strap (not shown).

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method for positioning a garment while breastfeeding, comprising the steps of:

providing a strap with means for securing the strap to itself;

raising a garment of a mother to a raised position with a breast of the mother exposed;

maintaining the garment in the raised position by extending the strap through a neck of the garment and around a lower hem of the garment to form a loop and securing the strap to itself; and the strap being used to concurrently hold in place a fabric draping material which is draped over the baby.

2. The method as defined in claim 1, the strap having an indicator which identifies whether the mother should be breastfeeding from her left breast or her right breast.

3. An apparatus for positioning a garment while breastfeeding, comprising:

a strap;

means for securing the strap to itself;

the strap extends through a neck of the garment and around a lower hem thereof; and an indicator attached to the strap which identifies whether a mother should be breastfeeding from her left breast or her right breast.

4. An apparatus for positioning a garment while breastfeeding, comprising:

a strap;

means for securing the strap to itself;

an indicator attached to the strap which identifies whether a mother should be breastfeeding from her left breast or her right breast; and means for securing the strap to itself includes a buckle and the indicator forms part of the buckle.

5. The apparatus as defined in claim 4, wherein the indicator includes a horizontal slotted opening in which a movable marker is positioned, and "L" representing left is marked on the indicator adjacent to a first end of the slotted opening and an "R" representing right is marked on the indicator adjacent to a second end of the slotted opening.

6. The apparatus as defined in claim 4, wherein the indicator glows in the dark.

7. The apparatus as defined in claim 4, wherein the indicator is a digital readout module.

8. The apparatus as defined in claim 7, wherein the means for securing the strap to itself includes a buckle and digital readout module forms part of the buckle.

9. The apparatus as defined in claim 8, wherein the digital readout module is detachably secured to the buckle.

10. The apparatus as defined in claim 7, wherein the digital readout module has at least one of the following auxiliary functions: a stop watch adapted to time a duration of breast feeding, a clock adapted to display current time, a timer adapted to count down time until a next scheduled breast feeding, or an alarm adapted to provide an auditory warning to announce the next scheduled breast feeding.

11. The apparatus as defined in claim 9, wherein the buckle has a receiving channel with a single access opening, the receiving channel having an inwardly extending peripheral flange, the digital readout module being matingly received within the receiving channel, means being provided to lock the digital readout module within the receiving channel.

* * * * *